US006273440B1

(12) United States Patent
Wilson

(10) Patent No.: US 6,273,440 B1
(45) **Date of Patent: *Aug. 14, 2001**

(54) METAL SPORTS BOARD

(75) Inventor: Ken Wilson, Poway, CA (US)

(73) Assignee: Reno Wilson, Inc., Poway, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/309,367

(22) Filed: May 11, 1999

Related U.S. Application Data

(63) Continuation-in-part of application No. 09/206,720, filed on Dec. 7, 1998, now Pat. No. 6,203,037.

(51) Int. Cl.[7] ..... A63C 17/01

(52) U.S. Cl. ..... 280/87.042

(58) Field of Search ..... 280/11.19, 11.26, 280/87.01, 87.041, 87.042, 842, 609, 610, 14.21, 14.22, 16; 441/68, 74; 164/112; 148/690

(56) References Cited

U.S. PATENT DOCUMENTS

| | | | | |
|---|---|---|---|---|
| 2,926,364 | * | 3/1960 | Cox | 280/610 |
| 3,561,783 | * | 2/1971 | Ellett | 280/16 |
| 3,722,900 | * | 3/1973 | Dickert | 280/842 |
| 3,762,734 | * | 10/1973 | Vogel | 280/610 |
| 4,082,578 | * | 4/1978 | Evancho et al. | 148/690 |
| 4,161,326 | | 7/1979 | Gaber . | |
| 4,182,520 | | 1/1980 | Stevenson . | |
| 4,196,916 | * | 4/1980 | Schorr | 280/87.042 |
| 4,337,963 | | 7/1982 | Stevenson . | |
| 4,458,907 | | 7/1984 | Meredith . | |
| 4,768,793 | * | 9/1988 | Spencer | 280/842 |
| 4,897,063 | | 1/1990 | Scheurer et al. . | |
| 5,248,160 | * | 9/1993 | Le Masson et al. | 280/610 |
| 5,249,819 | * | 10/1993 | Mayr | 280/610 |
| 5,267,743 | | 12/1993 | Smisek . | |
| 5,299,822 | * | 4/1994 | Mayr et al. | 280/610 |
| 5,312,258 | * | 5/1994 | Giorgio | 280/842 |
| 5,507,888 | * | 4/1996 | Dickson, Jr. et al. | 148/690 |
| 5,509,510 | * | 4/1996 | Ihm | 164/112 |
| 5,620,042 | * | 4/1997 | Ihm | 164/112 |

* cited by examiner

*Primary Examiner*—Frank Vanaman
(74) *Attorney, Agent, or Firm*—Lyon & Lyon LLP

(57) ABSTRACT

A sports board that is ridden by a person standing upon it includes an elongated metal board having a front end, a rear end, a top surface, a bottom surface, a left edge and a right edge, and one or more longitudinally elongated cavity forming sections. This basic structure can be utilized as the basic component for sports boards such as skateboards, wakeboards and snowboards.

14 Claims, 4 Drawing Sheets

METAL SPORTS BOARD

CROSS REFERENCE TO RELATED APPLICATIONS

This application is a continuation-in-part of U.S. patent application Ser. No. 09/206,720, filed on Dec. 7, 1998 U.S. Pat. No. 6,203,037.

BACKGROUND OF THE INVENTION

The invention relates to sports boards that are ridden by a person standing upon them, and more specifically to one whose basic structure is an elongated metal board. Some examples of sports boards are skateboards, snowboards and wakeboards.

The earliest skateboards were made of a plain flat piece of wood. Later models were made of other materials and had improved structure. The Gaber U.S. Pat. No. 4,161,326 discloses an improved skateboard having a replaceable arc-tail with a wear surface and further having wheels wells.

The Stevenson U.S. Pat. No. 4,182,520 discloses a skateboard structure having a central platform formed of a top piece and a bottom piece. The two pieces may be shaped to define an inner surface of cellular configuration so that when the two pieces are fitted together they define an internal reinforcing honeycomb-like core. The Stevenson U.S. Pat. No. 4,337,963 discloses the top and bottom pieces being formed of appropriate injection molded plastic material, such as polypropylene, polyethylene, polycarbonate, plexiglass, or other plastic material which is susceptible to injection molding; or aluminum casting or compression molded fiberglass; or any other material which may be molded or cast.

The Meredith U.S. Pat. No. 4,458,907 discloses a skateboard having a front member and a rear member and structure for allowing the length of the skateboard to be extended or retracted.

The Scheurer et al U.S. Pat. No. 4,897,063 discloses a reaction injection molded recreation board with spaced rectangular reinforcing rods. The rods are rectangular in cross section and are disposed between upper and lower surfaces of the board.

The Smisek U.S. Pat. No. 5,267,734 discloses a hollow elongated board having openings, formed in the underside of the board, adapted to receive standard skateboard wheels. The skateboard further employs wheel ramps on opposite sides of each wheel to provide a smooth under surface to aid in negotiation of large obstacles such as curbs, stairs, etc. and to allow the skateboard to glide over smaller objects.

In the late 1970's, an American skateboard manufacturer made his boards of aluminum plate material. These boards proved to be too heavy and too expensive and were not very popular. The edges of the skateboard, after heavy use, became razorblade sharp and were extremely dangerous.

The inventors recognized the problems of the prior art aluminum metal skateboards when they attempted to make the skateboards out of flat sheet aluminum. The flat sheet metal bent in the middle and could not endure hard riding. It was then decided to go with a thicker piece of aluminum and cutout sections of the metal to make it lighter while still maintaining sufficient structural support. The problem of razorblade sharp edges still occurred with the metal board and the metal board was still too heavy. Additionally, it also bent or buckled in the middle of the board when it was subjected to hard use.

It is an object of the invention to provide a novel metal board that is lightweight yet capable of withstanding the hard use of jumping actions by the rider and not bend or break.

It is another object of the invention to provide a metal board that could be used as a sports board that is ridden by a person standing upon it.

It is also an object of the invention to provide a novel metal board whose left and right edges have hollow or cavity-forming rails that are not subject to becoming razorblade sharp.

It is an additional object of the invention to provide a novel metal board that could be used in multiple sports such as skateboarding, wakeboarding and snowboarding.

It is a further object of the invention to provide a novel metal board that is economical to manufacture and market.

SUMMARY OF THE INVENTION

The novel sports board has been designed to be formed of a light-weight metal material having one or more longitudinally elongated cavity-forming sections formed by multiple support walls in the board, thereby allowing it to be as light, thin and strong as possible. The strength imparted to the board by the multiple support walls allow the sports board to be ridden hard without worrying about the board bending or breaking. A preferred embodiment of the metal board is made of 6000 series T-6 aircraft aluminum. Different aluminum or titanium may be used depending upon the physical properties desired such as tensile strength, yield strength, weight, etc.

The use of the sports board as a skateboard subjects it to tremendous forces when the rider is performing jumps. For instance, a 200-lb. rider that jumps from a height of 3 feet and absorbs the impact by bending his knees 3.6 inches subjects the skateboard to a force of 2000 lbs. A jump from a height of 6 feet produces a force of 4000 lbs. These forces will break wooden and flat plate metal skateboards.

Static tests for different aluminum boards for skateboards produced the following data:

For a flat board 0.100 inch think (without rails)

| Weight | Deflection |
|---|---|
| 200 lbs. | 1.07 inch |
| 250 lbs. | 1.34 inch |

For a flat plate board 0.1875 inch thick (without rails)

| Weight | Deflection |
|---|---|
| 200 lbs. | .162 inch |
| 250 lbs. | .203 inch |

For a board according to the inventors' design with a plate 0.100 inch thick and with the two rails 0.500 inch high and 0.625 inch wide with walls having a thickness of 0.0625 inch.

| Weight | Deflection |
|---|---|
| 200 lbs. | .048 inch |
| 250 lbs. | .060 inch |
| 1000 lbs. | .240 inch |

The weight of the hollow rail design above was well below 2.6 lbs. The weight of the board is thus lighter than either a wooden board or an aluminum plate board and much stronger than either of them.

The above advantages are obtained by a sports board adapted to be ridden by a person standing upon it. The sports board includes an elongated metal board having a front end, a rear end, a top surface, a bottom surface, a left edge and a right edge, and one or more longitudinally elongated cavity forming sections. This basic structure can be utilized as the basic component for sports boards such as skateboards, wakeboards and snowboards.

In an embodiment of the invention, wherein the elongated metal board includes a top wall, a bottom wall and N longitudinally elongated support walls that define N−1 longitudinally elongated cavity forming sections.

In another embodiment of the invention, the one or more longitudinally elongated cavity forming members extend from the front end to the rear end of the board.

In a further embodiment of the invention, the sports board is made of an aluminum or a titanium material.

In a still further embodiment of the invention, the metal board has an arcuate shaped front end and an arcuate shaped rear end. End guards made of a material such as plastic or wood may be secured to the front and the rear ends of the metal board.

In an additional embodiment of the invention, the metal board has a bent-up front tip portion and a bent-up rear tip portion.

In another embodiment of the invention, the metal sports board is designed for use as a skateboard, and accordingly, includes front and rear skateboard trucks secured to the bottom wall of the metal board.

In a further embodiment of the invention, the board deflects less than 0.162 in. with a load of 200 lbs.

In a still further embodiment of the invention, the board deflects less than 0.203 in. with a load of 250 lbs.

In an additional embodiment of the invention, at least one of the one or more longitudinally elongated cavity-forming sections includes a filler and the filler is a member selected from the group consisting of foam, foam plastic, wood, wood composite, compressed air, and an inflatable bladder.

In an additional embodiment of the invention, the one or more longitudinally elongated cavity-forming sections includes a generally rectangular cross section.

In an additional embodiment of the invention, the metal sports board includes a length L1 of 24–60 inches, a width W1 of 5–12 inches, and a height H1 of 0.20–0.80 inches.

In a further embodiment of the invention, the metal sports board includes a length L1 of 24–72 inches, a width W1 of 6–25 inches, and a height H1 of 0.20–0.80 inches.

In a still further embodiment of the invention, the metal sports board includes a length L1 of 24–65 inches, a width W1 of 6–35 inches, and a height H1 of 0.20–0.80 inches.

Another aspect of the invention includes a method of manufacturing a sports board. The method includes providing an elongated metal board having a front end, a rear end, a top surface, a bottom surface, a left edge, a right edge, and one or more longitudinally elongated hollow sections; and shaping the metal board near said front end and rear end at a predetermined angle.

In an embodiment of the invention, the method includes heat treating the metal board to reduce stresses formed in the metal board.

In an additional embodiment of the invention, the elongated metal board is manufactured by extruding a metal board.

In a further embodiment of the invention, the step of providing a metal board includes providing a metal board in less than a T-5 tempered hardness condition.

In another embodiment of the invention, the elongated metal board is manufactured by casting a metal board around a filler material. The filler material is a member selected from the group consisting of foam, foam plastic, wood, wood composite, and an inflatable bladder.

In an additional embodiment of the invention, the method includes shaping the front and rear ends of the metal board into a predetermined shape.

In a further embodiment of the invention, the metal board is made of an aluminum material.

A further aspect of the invention involves a method of manufacturing a metal sports board. The method includes extruding an elongated metal board made of an aluminum alloy, the elongated metal board having a front end, a rear end, a top surface, a bottom surface, a left edge, a right edge, and one or more longitudinally elongated hollow sections; shaping the elongated metal board; and hardening the elongated metal board by subjecting the metal board to a heat treatment process.

In an embodiment of the invention, aluminum alloy is a 6000 series alloy.

In another embodiment of the invention, the aluminum alloy is a 6005 alloy.

In an additional embodiment of the invention, the metal board is in a T-4 tempered hardness condition before shaping the elongated metal board and is hardened by the heat treatment process to at least a T-5 hardness condition after shaping the metal board.

In a further embodiment of the invention, the method further includes annealing the elongated metal board.

In a still further embodiment of the invention, the aluminum alloy is a 6000 series alloy.

In an additional embodiment of the invention, the aluminum alloy is a 6061 alloy.

In another embodiment of the invention, the metal sports board is annealed to a T-0 tempered hardness condition.

In a further embodiment of the invention, the metal sports board is hardened by the heat treatment process to at least a T-5 tempered hardness condition after shaping the metal sports board.

An additional aspect of the invention involves a method of manufacturing a metal sports board. The method includes providing an elongated metal board, annealing the elongated metal board, shaping the elongated metal board, and hardening the elongated metal board.

In an embodiment of the invention, annealing includes annealing to less than a T-5 hardness condition.

In an alternative embodiment of the invention, hardening includes hardening to at least a T-5 hardness condition.

DESCRIPTION OF THE PREFERRED EMBODIMENT

Figure 1:
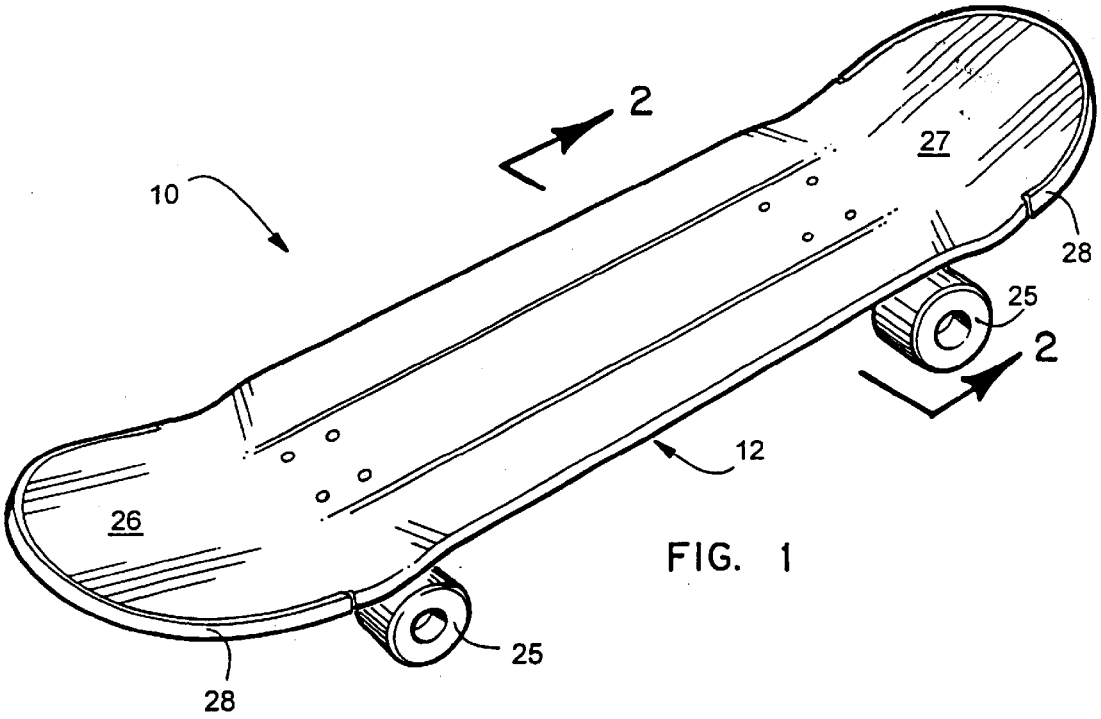
FIG. 1 is a front perspective view of the novel metal board utilized as a skateboard.
Figure 2:
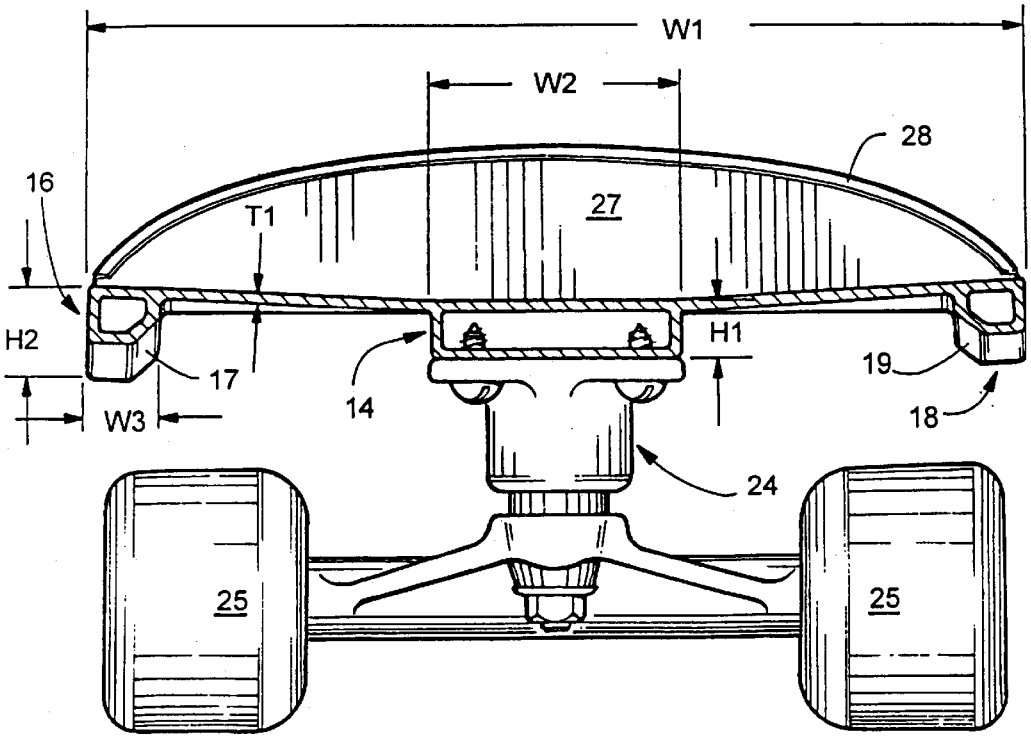
FIG. 2 is a cross sectional view taken along lines 2—2 of FIG. 1.
Figure 3:
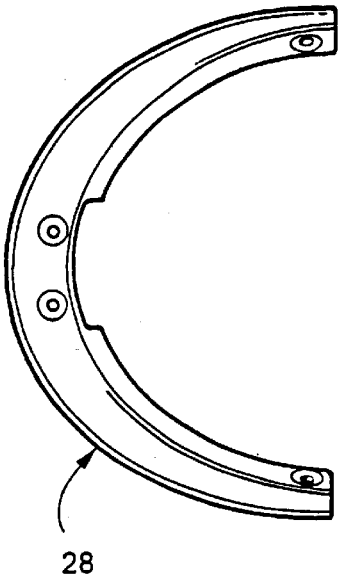
FIG. 3 is a bottom plan view of one of the end guards for the metal board.

A novel metal sports board constructed in accordance with an embodiment of the invention will now be described by referring to FIGS. 1–6 of the drawings. The illustrated sports board is a skateboard designated by the reference numeral 10 and its major component is an elongated light-weight metal board 12. Although the novel metal sports board of the present invention is described for use as a skateboard, it will be readily apparent to those skilled in the art that the sports board may be used for other sports activities such as, but not by way of limitation, snowboarding and wakeboarding.

The metal board 12 has a length L1 in the range of 24–60 inches and a width W1 in the range of 5–12 inches. The metal sports board 12 includes a main body portion 13 and opposite tip portions 26, 27. The board 12 includes an upper surface 29 with a concave transverse contour.

The metal board 12 also includes one or more longitudinally elongated cavity-forming sections. A first longitudinally elongated cavity-forming section identified as cavity-forming keel 14 is located in the center of the metal sports board 12. The cavity-forming keel 14 has a substantially rectangular cross sectional shape and has a height H1 in the range of 0.200–0.800 inch and a width W2 in the range of 0.500–3.000 inch, when the metal board 12 is used as a skateboard. The first elongated cavity-forming section 14 includes a longitudinally elongated cavity 30 defined by top wall 32, bottom wall 34 and opposite interior support walls 36, 38. The thickness T1 of the top wall of the metal board 12 is in the range of 0.050–0.250 inch. The first elongated cavity-forming section 14 preferably extends from a front arcuate edge 40 to a rear arcuate edge 42 of the metal sports board 12. When the metal board 12 is used as a snowboard, the height H1 is 0.200–0.800 inch, the width W1 is 6–25 inches and the length L1 is 24–72 inches. When the metal board 12 is used as a wakeboard, the height H1 is 0.200–0.800 inch, the width W1 is 6–35 inches and the length L1 is 24–65 inches.

The metal board 12 also includes a second longitudinally elongated cavity-forming section identified as left rail 16 and a third longitudinally elongated cavity-forming section identified as right rail 18 that preferably extend from the front edge 40 to the rear edge 42 of the metal sports board 12. Each longitudinally elongated cavity-forming section 16, 18 includes a longitudinally elongated cavity 46, 48 defined by top wall 32, bottom wall 48, 50, interior support wall 52, 54, exterior support wall 56, 58 and inner inclined walls 17, 19. The inner inclined walls 17, 19 of the respective rails 16, 18 are inclined to allow clearance space for the wheels when the rider weights the metal board heavily to a particular side edge. The rails 16, 18 preferably have a height H2 in the range of 0.200–0.800 inch and a width W3 in the range of 0.300–1.00 inch.

Although the longitudinally elongated cavity-forming sections 14, 16, 18 are described as extending the full length of the metal sports board, it will be readily appreciated by those skilled in the art that any or all of the elongated cavity-forming sections 14, 16, 18 may extend less than the full length of the metal sports board 12. Further, just as the longitudinally elongated hollow sections 14, 16, 18 share a common top wall 32, they may similarly share a common bottom wall. Any or all of the elongated cavity-forming chambers 30, 46, 48 may be filled with an appropriate light-weight filler material such as, but not by way of limitation, a foamed plastic, a wood material, a wood composite material or an inflatable bladder to aid in the strength and/or manufacturing of the metal sports board 12. The elongated cavity-forming sections 14, 16, 18 improve the strength of the metal sports board 12 without adding significantly to the weight of the board 12. The improved strength is provided by the longitudinally elongated generally vertical support walls 36, 38, 52, 54, 56, 58.

A pair of skateboard trucks 24 are secured to the bottom surface of the main body portion 13 of the metal board 12. Each truck 24 has a pair of wheels 25.

The metal sports board 12 includes upwardly inclined tip portions 26, 27 near the respective edges 40, 42. The tip portions 26 are inclined upwardly with respect to the main body portion 13. End guards 28 may be secured to the edges 40, 42 of the tip portions 26, 27. The end guards 28 preferably include one or more protruding portions 29 that plug into respective cavities in the metal sports board 12. The end guards 28 may be additionally secured to the edges 40, 42 using appropriate fasteners. In an alternative embodiment, the end guards 28 do not include the protruding portions 29 and, hence, are secured to the outside of the board 12 with appropriate fasteners. The end guards 28 may be made of plastic, wood or similar material.

It will be readily apparent to those skilled in the art that in alternative embodiment of the invention, the metal sports board 12 may have one or no upwardly inclined tip portions. For example, if the metal sports board was used for snowboarding, the board may have only one upwardly inclined tip portion. Alternatively, if the metal sports board was used for wakeboarding, the board may have no upward inclined tip portion. Further, the edges 40, 42 may have a shape other than arcuate.

Figure 4:
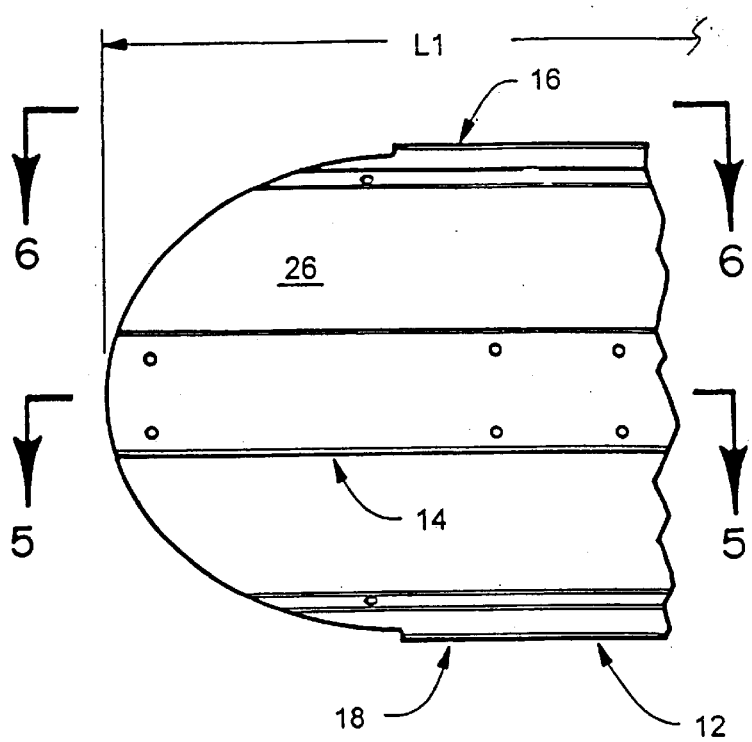
FIG. 4 is a partial bottom plan view of one end of the metal board.

FIG. 4 is a partial bottom plan view of a front part of the metal sports board 12 without the trucks 24 and wheels 25 shown. In the illustrated embodiment shown in FIGS. 1–6, the rear part of the board 12 is substantially identical.

Figure 5:
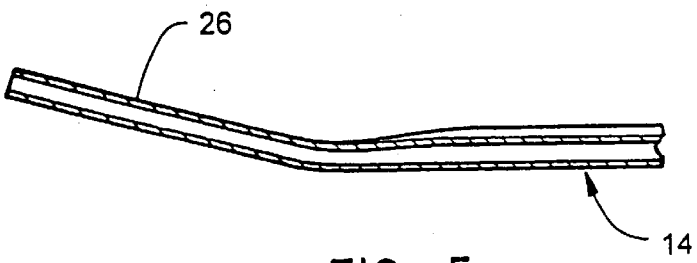
FIG. 5 is a cross sectional view taken along lines 5—5 of FIG. 4.

FIG. 5 is a cross sectional view taken along lines 5—5 of FIG. 4 and illustrates the elongated cavity-forming nature of the board 12, especially the central longitudinally elongated portion 14.

Figure 6:
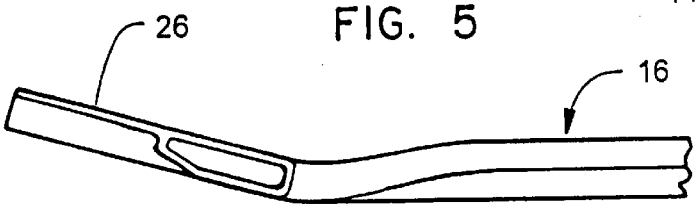
FIG. 6 is a side elevation view taken along lines 6—6 of FIG. 4.

FIG. 6 is a side elevation view taken along lines 6—6 of FIG. 4 of the front part of the metal sports board 12 and illustrates the front edge 40 of the board 12 without the end guard 28.

Figure 7:
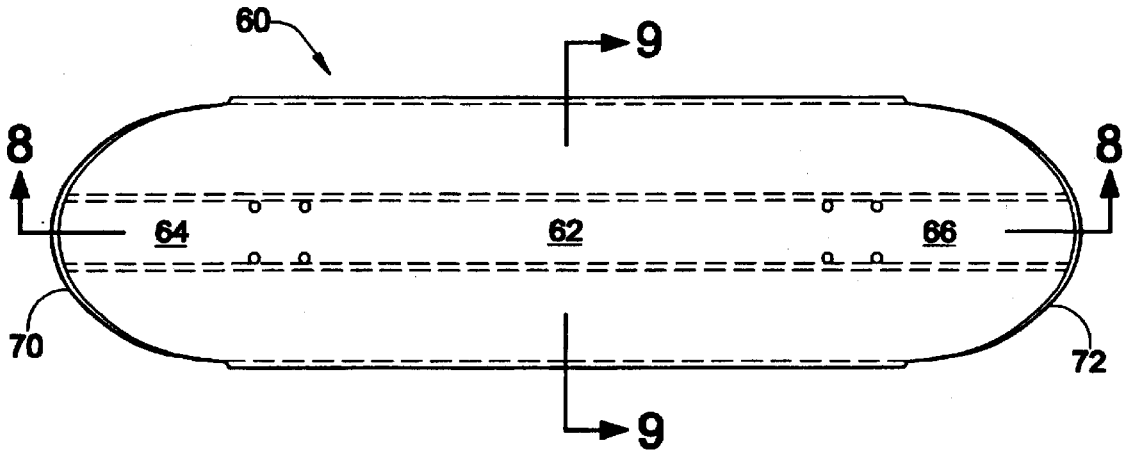
FIG. 7 is a bottom plan view of a metal board constructed in accordance with an additional embodiment of the invention.
Figure 8:
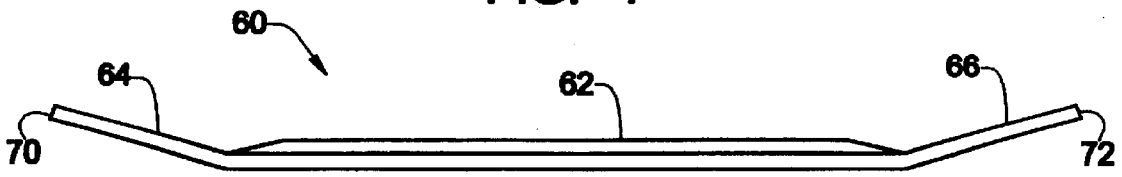
FIG. 8 is a cross sectional view taken along lines 8—8 of FIG. 7.
Figure 9:
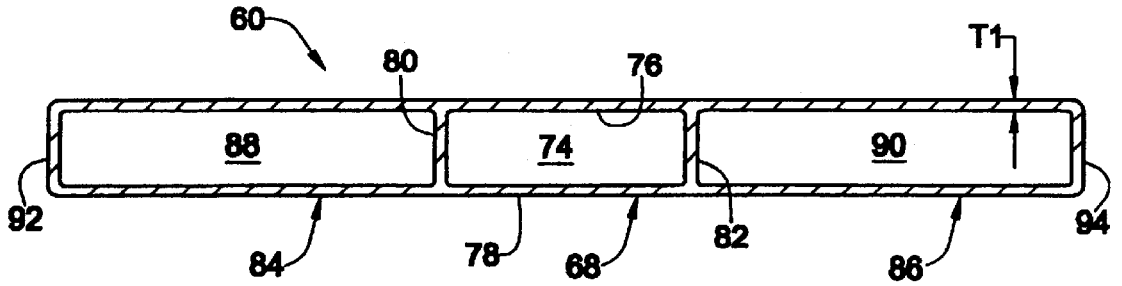
FIG. 9 is a cross sectional view taken along lines 9—9 of FIG. 7.

With reference to FIGS. 7–9, a bottom plan view of a light-weight metal sports board 60 constructed in accordance with an additional embodiment of the invention is shown. The metal sports board 60 has similar W1, H1 and T1 measurements to those described above. The metal sports board 60 includes a main body portion 62 and opposite tip portions 64, 66. The metal sports board 60 also includes one or more longitudinally elongated cavity-forming sections. A first or central longitudinally elongated cavity-forming section 68 having a generally rectangular cross section preferably extends from a front edge 70 to a rear edge 72 of the board 60. The central longitudinally elongated cavity-forming section 68 includes a longitudinally elongated cavity-forming chamber 74 defined by top wall 76, bottom wall 78 and opposite interior support walls 80, 82.

The metal board 60 also includes an adjacent second longitudinally elongated cavity-forming section 84 and an adjacent third longitudinally elongated cavity-forming section 86, both of which preferably extend from the front edge 70 to the rear edge 72 of the metal sports board 12. Each longitudinally elongated cavity-forming section 84, 86 includes longitudinally elongated cavities 88, 90 defined by top wall 76, bottom wall 78, generally vertical interior support walls 80, 82, and exterior support walls 92, 94. Although the support walls 80, 82, 92, 94 are illustrated as being generally vertical, it will be readily apparent to those skilled in the art that any or all of these supporting walls may be inclined at an angle other than 90° with respect to the walls 76, 78. The second longitudinally elongated cavity-forming section 84 and third longitudinally elongated cavity-forming section 86 both have a generally rectangular cross section, similar to the central longitudinally elongated cross section 68, except the sections 84, 86 are wider.

Similar to the metal sports board 12 described above with respect to FIGS. 1–6, although the longitudinally elongated cavity-forming sections 68, 84, 86 are described as extending the full length of the metal sports board 60, it will be readily appreciated by those skilled in the art that any or all of the elongated cavity-forming sections 68, 84, 86 may extend less than the full length of the metal sports board 60. Also, any or all of the elongated cavities 68, 84, 86 may be filled with an appropriate light-weight filler material such as, but not by way of limitation, a foamed plastic, a wood material, a wood composite material or an inflatable bladder to aid in the strength and/or manufacturing of the metal sports board 60. The elongated cavity-forming sections 68, 84, 86 improve the strength of the metal sports board 60 without adding significantly to the weight of the board 60. The improved strength is provided mainly by the longitudinally elongated generally vertical support walls 80, 82, 92, 94.

Figure 10:
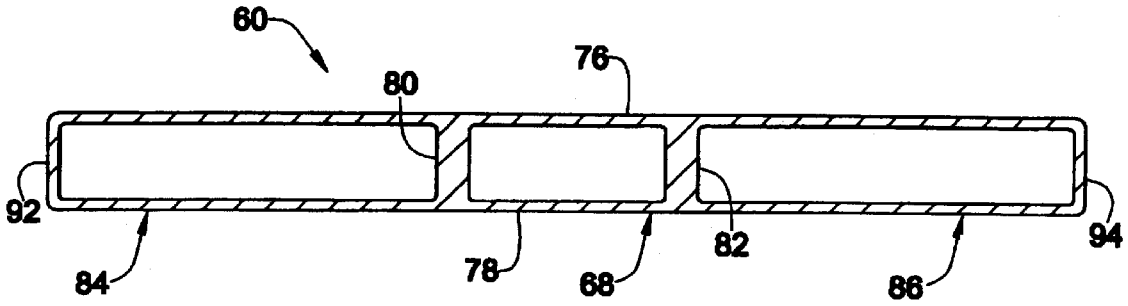
FIG. 10 is a cross sectional view, similar to FIG. 9, of a metal sports board constructed in accordance with a further embodiment of the invention.

With reference to FIG. 10, in an alternative embodiment of the metal sports board 60, the generally vertical interior walls 80, 82 may be thicker in order to provided more support for the board 60. Also, the bottom wall 78 may be thicker in order to support fasteners for a pair of trucks such as trucks 24 described above.

Figure 11:
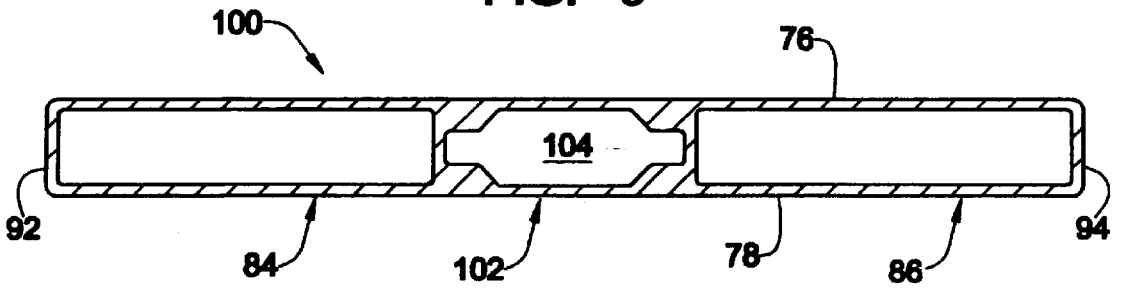
FIG. 11 is a cross sectional view, similar to FIG. 9, of a metal sports board constructed in accordance with a still further embodiment of the invention.

With reference to FIG. 11, a light-weight metal sports board 100 constructed in accordance with an additional embodiment of the invention will be described. The metal sports board 100 is similar to the embodiments of the metal sports board 60 described in conjunction with FIGS. 7–10. Consequently, like elements are identified with the same reference numerals and are not described in further detail below. The metal sports board 100 includes a first or central longitudinally elongated cavity-forming section 102 having a longitudinally elongated cavity 104 with a cross-like cross section preferably extending from a front edge 70 to a rear edge 72 of the board 100.

Figure 12:
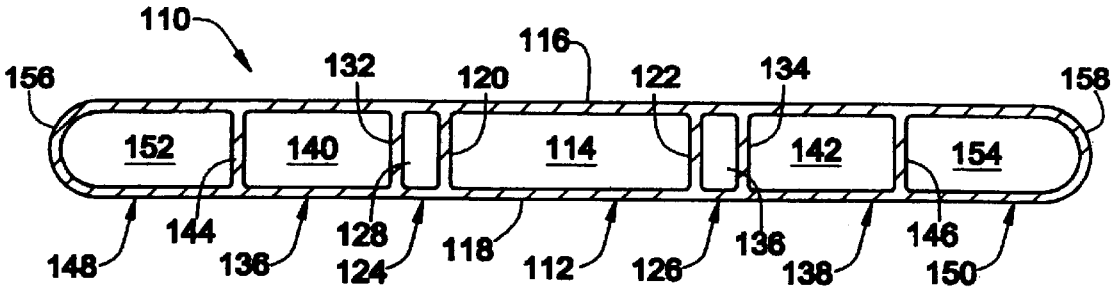
FIG. 12 is a cross sectional view, similar to FIG. 9, of a metal sports board constructed in accordance with another embodiment of the invention.

With reference to FIG. 12, a cross sectional view of a light-weight metal sports board 110 constructed in accordance with an additional embodiment of the invention is shown. The metal sports board 110 has similar W1, H1 and T1 measurements to those described above. The metal sports board 110 includes one or more longitudinally elongated cavity-forming sections. A first or central longitudinally elongated cavity-forming section 112 having a generally rectangular cross section preferably extends from a front edge 70 to a rear edge 72 of the board 110. The central longitudinally elongated cavity-forming section 112 includes a longitudinally elongated cavity-forming cavity 114 defined by top wall 116, bottom wall 118 and opposite interior support walls 120, 122.

The metal board 110 also includes an adjacent second longitudinally elongated cavity-forming section 124 and an adjacent third longitudinally elongated cavity-forming section 126, both of which preferably extend from the front edge 70 to the rear edge 72 of the metal sports board 110. Each longitudinally elongated cavity-forming section 124, 126 include longitudinally elongated cavities 128, 130 defined by top wall 116, bottom wall 118, generally vertical interior support walls 120, 122, and second interior support walls 132, 134. The second longitudinally elongated cavity-forming section 124 and third longitudinally elongated cavity-forming section 126 both have a generally rectangular cross section, similar to the central longitudinally elongated cross section 112, except the sections 124, 126 are narrower.

The metal board 110 also includes an adjacent fourth longitudinally elongated cavity-forming section 136 and an adjacent fifth longitudinally elongated cavity-forming section 138, both of which preferably extend from the front edge 70 to the rear edge 72 of the metal sports board 110. Each longitudinally elongated cavity-forming section 136, 138 include longitudinally elongated cavities 140, 142 defined by top wall 116, bottom wall 118, generally vertical second interior support walls 132, 134, and third interior support walls 144, 146. The fourth longitudinally elongated cavity-forming section 136 and fifth longitudinally elongated cavity-forming section 138 both have a generally rectangular cross section, similar to cross section of the central longitudinally elongated cavity-forming section 112.

The metal board 110 also includes an adjacent sixth longitudinally elongated cavity-forming section 148 and an adjacent seventh longitudinally elongated cavity-forming section 150, both of which preferably extend from the front edge 70 to the rear edge 72 of the metal sports board 110. Each longitudinally elongated cavity-forming section 148, 150 include longitudinally elongated cavities 152, 154 defined by top wall 116, bottom wall 118, generally vertical third interior support walls 144, 146, and fourth exterior support walls 156, 158. The fourth exterior support walls 156, 158 have an arcuate cross section. The sixth longitudinally elongated cavity-forming section 148 and seventh longitudinally elongated cavity-forming section 150 both have a generally rectangular cross section, similar to cross section of the central longitudinally elongated cavity-forming section 112.

Similar to the metal sports board 12 described above with respect to FIGS. 1–6, although the longitudinally elongated cavity-forming sections 112, 124, 126, 136, 138, 148, 150 are described as extending the full length of the metal sports board 110, it will be readily appreciated by those skilled in the art that any or all of the elongated cavity-forming sections 112, 124, 126, 136, 138, 148, 150 may extend less than the full length of the metal sports board 100. Also, any or all of the elongated cavities 112, 124, 126, 136, 138, 148, 150 may be filled with an appropriate light-weight filler material such as, but not by way of limitation, a foamed plastic, a wood material, a wood composite material or an inflatable bladder to aid in the strength and/or manufacturing of the metal sports board 110. The large number of elongated cavity-forming sections 112, 124, 126, 136, 138, 148, 150 improve the strength of the metal sports board 110 without adding significantly to the weight of the board 110. The improved strength is provided mainly by the longitudinally elongated generally vertical support walls 120, 122, 132, 134, 144, 146, 156, 158. Generally, the number of elongated hollow sections in the metal sports board is N−1, where N is the number of longitudinally elongated support walls.

It will be readily appreciated by those skilled in the art that in a further embodiment of the invention, the metal sports board may include a number of adjacent longitudinally elongated hollow sections and support walls not shown and described herein.

The metal sports board of the present invention is preferably manufactured by extruding an elongated metal board made of an aluminum alloy to have one or more longitudinally elongated cavity-forming sections. Preferably, the metal sports board has the three longitudinally elongated cavity-forming sections as discussed above with respect to FIGS. 9–11. Although the metal sports board is preferably made of aluminum, other metal materials such as, but not by way of limitation, a titanium alloy may be used. The aluminum alloy preferably used is either a 6061 alloy or a 6005 alloy in the 6000 series of this alloy. Of course, other alloys may be used.

If a 6061 alloy is used, the method of manufacture preferably includes extruding the elongated metal board, annealing or softening the metal board to less than a T-5 hardness condition, preferably a T-0 tempered hardness condition (e.g., spraying the metal board with water within a few seconds after the metal board comes out of the mold), bending or shaping the metal board, and hardening the metal board so as to retain the desired shape by a heat treatment process to at least a T-5 tempered hardness condition (e.g., solution aging the metal board for approximately 8 hours at 350 degrees).

If a 6005 alloy is used, the annealing process described above is not required because after the extrusion step, the metal board is at a T-4 tempered hardness condition. The method further includes shaping the metal board, and hardening the metal board by a heat treatment process to at least a T-5 tempered hardness condition. If the metal sports board is to be used as a skateboard, the board is preferably shaped by bending the front and rear portions of the metal sports board to a predetermined angle so that a bent-up tip portion and a bent-up rear tip portion are formed. Obtaining the desired shape of the front and rear parts may also involve machining the front and rear parts of the metal board into a predetermined shape.

In summary, the novel method of manufacturing a metal sports board includes providing the metal sports board, e.g., extruding the board, annealing or softening the metal sports board to inhibit stress formation or cracking in the board, shaping the board, and hardening the board to retain its shape, e.g., heat treatment process. The metal sports board is preferably annealed to less than a T-5 hardness condition before shaping the board and hardened to at least a T-5 hardness condition. As discussed above, if the metal sports board is initially provided in a sufficient soft condition, less than a T-5 hardness, the annealing step may not be used. By not shaping the metal sports board while it is in a hard condition, e.g., a T-6 condition, the method of the present invention inhibits cracking and breaking of the board over time, allowing the rider to ride the sports board hard without worrying about the board bending or breaking.

Although the step of providing an elongated metal board preferably includes extruding the elongated metal board, other manufacturing processes besides extruding may be used to manufacture the metal sports board. For example, the metal sports board may be manufactured by bending a single piece of aluminum or other metal to the desired shape. Alternatively, a separate top sports board member and bottom sports board member may be manufactured and affixed together so as to form a metal sports board having one or more longitudinally elongated cavity-forming sections. For example, the top sports board member and the bottom sports board member may each be separate pieces of aluminum that are bent to a desired shape and welded together. Alternatively, the separate members could be extruded separately and welded together to form the metal sports board. Alternatively, the one or more longitudinally elongated cavity-forming sections may be formed by casting or extruding the metal sports board with a fluid filled air bladder on the inside and removing the bladder after forming the metal sports board. Other light-weight filler materials such as, but not by way limitation, foam, wood, or wood composite in the shape of the longitudinally elongated cavity may be used to assist in creating the one or more longitudinally elongated cavity-forming sections. These light-weight filler materials may also help to reduce the weight of the metal sports board while increasing the strength of the sports board. Using an air bladder or other filler material also allows longitudinally elongated cavity-forming sections to be shorter than the full length of the board to be formed.

It should be noted, the type of metal sports manufactured, e.g., skateboard, snowboard, wakeboard, dictates how the board will be manufactured. For example, if the metal sports board is intended for use as a wakeboard or snowboard, the metal sports board will be shaped differently than that shown and described above.

While the particular invention as herein shown and disclosed in detail is fully capable of obtaining the objects and providing the advantages stated, it is to be understood that this disclosure is merely illustrative of the presently preferred embodiments of the invention and that no limitations are intended other than as described in the appended claims.

What is claimed is:

1. A skateboard that is adapted to be ridden by a user standing upon it, comprising: an elongated extruded aluminum metal board; said metal board having a front end, a rear end, a top surface, a bottom surface, a left edge, a right edge, a width adapted to accommodate the user's feet in a direction generally perpendicular to the longitudinal axis of the board, and multiple continuous, closed cavity forming members extending substantially the length of the board, at least one of the cavity forming members having a height H1 and a width W2 and W2 is greater than H1.

2. A skateboard as recited in claim 1, wherein said at least one cavity forming member having a height H1 and a width W2 has a substantially rectangular cross-sectional configuration.

3. A skateboard as recited in claim 1, wherein said metal board has an arcuate shaped front end and an arcuate shaped rear end.

4. A skateboard as recited in claim 3, wherein plastic end guards are secured to said front and rear ends of said metal board.

5. A skateboard as recited in claim 1, wherein said top surface of said metal board has a concave transverse contour.

6. A skateboard as recited in claim 1, wherein said metal board has a bent-up front tip portion and a bent-up rear tip portion.

7. A skateboard as recited in claim 1, further comprising front and rear skateboard trucks secured to said bottom surface of said metal board.

8. A skateboard as recited in claim 1, wherein said board deflects less than 0.162 in. with a load of 200 lbs.

9. A skateboard as recited in claim 1, wherein said board deflects less than 0.203 in. with a load of 250 lbs.

10. A skateboard as recited in claim 1, wherein the elongated metal board includes a top wall, a bottom wall and N longitudinally elongated support walls that define N−1 longitudinally elongated cavity forming members extending substantially the length of the board.

11. A skateboard as recited in claim 1, wherein end guards are secured to said front and rear ends of said metal board at said multiple continuous, closed cavity forming members.

12. A skateboard as recited in claim 1, wherein at least one of said multiple continuous, closed cavity forming members includes a filler.

13. A skateboard as recited in claim 12, wherein said filler is a member selected from the group consisting of foam, foam plastic, wood, wood composite, and an inflatable bladder.

14. A skateboard as recited in claim 1, wherein said metal board includes a first, central longitudinally elongated cavity forming section having a generally rectangular cross section, second and third adjacent longitudinally elongated cavity forming sections having generally rectangular cross sections that are narrower then the cross section of the first section, fourth and fifth adjacent longitudinally elongated cavity forming sections having generally rectangular cross sections of approximately the same cross section as the cross section of the first section, and sixth and seventh adjacent longitudinally elongated cavity forming sections having generally rectangular cross sections of approximately the same cross section as the cross section of the first section.

* * * * *